US010233055B1

(12) United States Patent
Ascua et al.

(10) Patent No.: US 10,233,055 B1
(45) Date of Patent: Mar. 19, 2019

(54) PNEUMATIC VACUUM ELEVATOR SEAL

(71) Applicants: Carlos M. Ascua, Parana (AR); Juan Carlos de Ledebur, Miami, FL (US)

(72) Inventors: Carlos M. Ascua, Parana (AR); Juan Carlos de Ledebur, Miami, FL (US)

( * ) Notice: Subject to any disclaimer, the term of this patent is extended or adjusted under 35 U.S.C. 154(b) by 0 days.

(21) Appl. No.: 15/813,347

(22) Filed: Nov. 15, 2017

(51) Int. Cl.
*B66B 9/04* (2006.01)
*B66B 11/02* (2006.01)

(52) U.S. Cl.
CPC ..... *B66B 11/0226* (2013.01); *B66B 9/04* (2013.01); *B66B 11/026* (2013.01)

(58) Field of Classification Search
CPC ..... B66B 11/005; B66B 17/02; B66B 19/002; B66B 7/028; B66B 7/023; B66B 7/024; B66B 9/04; B65G 51/06
See application file for complete search history.

(56) References Cited

U.S. PATENT DOCUMENTS

| | | | | |
|---|---|---|---|---|
| 3,949,953 A * | 4/1976 | Hopkins | ..... | B65G 51/06 187/273 |
| 4,066,298 A * | 1/1978 | Sakamoto | ..... | B65G 51/06 406/189 |
| 5,181,807 A * | 1/1993 | Anders | ..... | B65G 51/06 406/190 |
| 7,455,481 B1 * | 11/2008 | Keller | ..... | B65G 51/06 406/184 |
| 8,491,229 B2 * | 7/2013 | Cornelius | ..... | B65D 59/04 406/190 |
| 9,845,155 B2 * | 12/2017 | Brown | ..... | B64D 9/00 |

* cited by examiner

*Primary Examiner* — Diem M Tran
(74) *Attorney, Agent, or Firm* — Patent CEO, LLC; Phillip Vales

(57) ABSTRACT

A pneumatic vacuum elevator cylinder has a cabin inserted therein. A structural plate of the cabin has a liner attached thereto. This liner has an integral bumper formed on an external surface thereof for impact the inner surfaces of the pneumatic vacuum elevator cylinder. The bumpers have a variety of features that facilitate the smooth ride of the cabin within the elevator cylinder.

20 Claims, 6 Drawing Sheets

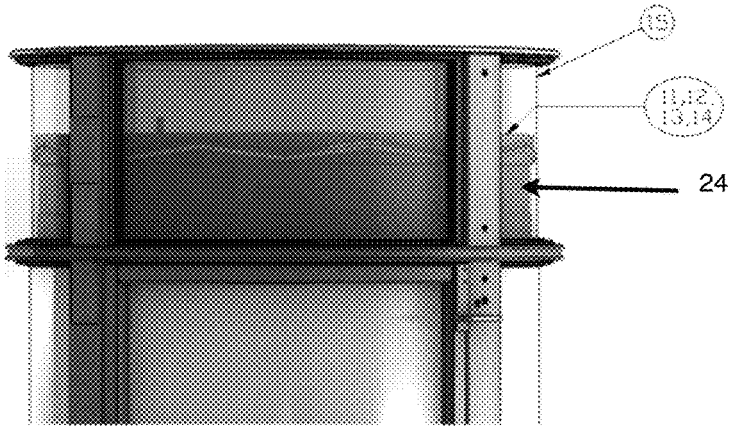
FIG. 3A
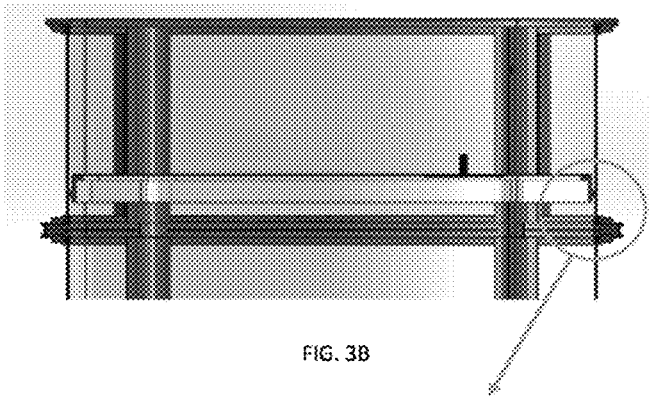
FIG. 3B
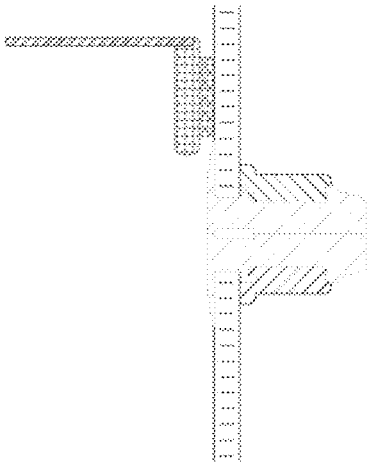
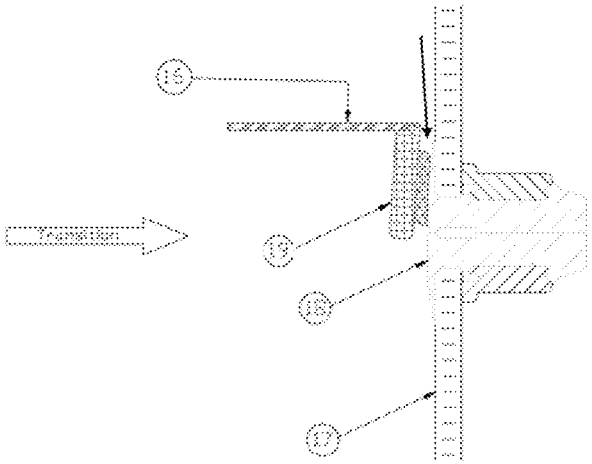
FIG. 3C
FIG. 3D

PNEUMATIC VACUUM ELEVATOR SEAL

FIELD OF THE INVENTION

The present invention relates to a Pneumatic Vacuum Elevator; more particularly, the present invention relates to devices that assist in vibration reduction during motion of the Cabin as it rides within the Elevator Cylinder.

BACKGROUND OF THE INVENTION

Elevators typically use countervailing weights in order to facilitate a passenger cabin moving up and down an elevator shaft in large office buildings, hospitals, factories and similar structures. These types of elevators require a great deal of space, maintenance, equipment and machinery. More recently, a new type of elevator has been developed known as a vacuum elevator system. This elevator uses air pressure to cause the motion of the cabin within a thoroughfare or tubular cylinder that uses the air within it as a working fluid upon the confines of the cabin. Brakes, motors, valves, electronic controls and other equipment work in concert to ensure a safe and pleasant riding experience for each occupant therein.

Modern elevator cabins use a liner attached to a structural plate of the cabin to facilitate the transfer from one position to another within an elevator cylinder. For Example, FIG. 1A presents a view of a prior art rubber liner used to attach to a cabin plate. A completed liner 1 is shown in the figure; it is an extruded group of components that are attached together with U shaped connectors 3 at various intervals. The U shaped connectors 3 are similarly rubber extrusions and are attached at regular intervals connecting each component using the two upper ends of the U; one upper end of the U to an end of a first component and the other upper end of the U to an end of a second component. This process is completed until a ring is formed completing the liner 1. A bumper 2 is integral with the liner components and forms a horizontal uniform arc across the side of each component as in FIG. 1A.

FIG. 1B presents a side view of a prior art liner having a bumper having a uniform linear pattern. This view shows a prior art liner 1 having a bumper 2 that is shaped in a linear pattern (from this perspective) and is extruded integrally with the components of the liner 1.

FIG. 1C presents a view of a prior art liner having a bumper using a linear pattern as it is attached to a cabin plate. Here the liner 1 components are attached to an external side of a cabin plate 4 using adhesives so that the bumper 2 is disposed radially outwards and away from the cabin plate so that it can impact an elevator cylinder internal surface. The U shaped connectors 3 are also attached to U shaped depressions using adhesives in the cabin plate to ensure a proper engagement of the liner 1 with the cabin plate 4.

FIG. 1D presents a side view of a prior art elevator cylinder 5 having a cabin inserted therein where the cabin has a liner 1 having a bumper 2 and connectors 3 such that the back of the liner 1 components and connectors is attached to a cabin plate 4 that is integral with the cabin in an embodiment disclosed herein.

One of the problems with this type of system is that the prior art liner 1 bumpers 2 are straight when viewed in some perspectives; for example, from the side of the liner 1 as shown in FIG. 1B. Of course, in FIG. 1A, 1C this is shown to be a horizontal circumferential continuous feature otherwise known as an arc.

This presents a problem for the cabin in that there is a rough transition from one location to another as the liner 1 and its associated bumpers 2 grip the inner surface of the elevator cylinder and do not permit a smooth transition from one section of an elevator cylinder portion to another elevator cylinder portion. Further, there is noise within the cabin that is unpleasant to cabin passengers as another consequence of the side viewed linear bumpers 2 that form an arc in a perspective view.

Accordingly, there needs to be some solutions to overcome the aforementioned problems.

SUMMARY OF THE INVENTION

The present invention overcomes the deficiencies of the known art and the problems that remain unsolved by providing as described herein and in the accompanying drawings.

An elevator cabin seal system, comprising:

an elevator cabin having:

an elevator cabin structural plate having a bottom surface, a top surface and an edge that integrates the top surface with the bottom surface, wherein the elevator cabin structural plate is attached to a top portion of an elevator cabin lateral surface;

a first liner component bumper attached to the edge of the elevator cabin structural plate wherein the first liner component bumper impacts an internal surface of an elevator channel;

wherein the first liner component bumper has a cutout on its back side having a lip directly attached to the edge of the elevator cabin structural plate; and a ledge proximal to the lip attached to the bottom surface of the elevator cabin structural plate.

In another aspect, wherein the first liner component bumper is formed as a diagonal line.

In another aspect, wherein the first liner component bumper is formed as an arch.

In another aspect, wherein the first liner component bumper is formed as a polygon.

In another aspect, wherein the first liner component bumper is formed as an ellipse.

In another aspect, wherein the first liner component bumper is formed as a curved shape.

In another aspect, wherein the first liner component bumper is formed as a first shape above a second shape.

In another aspect, wherein the first liner component bumper is formed as a first shape followed by a discontinuity and then a second shape.

In another aspect, wherein the first liner component bumper has a diagonal line therewith.

In another aspect, wherein the first liner component bumper has a curved arch therewith.

In another aspect, wherein the first liner component bumper has a triangular arch therewith.

In another aspect, wherein the first liner component bumper has a polygon therewith.

In another aspect, wherein the first liner component bumper has an ellipse therewith.

In another aspect, wherein the first liner component bumper has a curved shape therewith.

In another aspect, wherein the first liner component bumper has a first shape above a second shape therewith.

In another aspect, wherein the first liner component bumper has a line therewith.

An elevator cabin seal system comprising:

a first liner component having a first bumper integrally formed thereon wherein the first bumper is not inflatable and wherein the first liner component is attached to a connector;

a second liner component having another bumper integrally formed therewith wherein the another bumper is not inflatable and wherein the second liner component is attached to the connector; such that the first liner component and the second liner component and the connector are attached to a lateral edge of a structural cabin plate; and wherein the first bumper is from a set of bumpers of: triangular arch, ellipse, diagonal line.

In another aspect, wherein the bumper has a diagonal line therewith.

A elevator plate liner system comprising:

a first liner component attached to a cabin structural plate and also attached to a connector having a first changing bumper integrally formed on the first liner component wherein the first changing bumper is not inflatable;

a second liner component attached to the cabin structural plate and also attached to the connector having a second changing bumper integrally formed on the second liner component wherein the second changing bumper is not inflatable; wherein the first changing bumper impacts an internal surface of a cabin thoroughfare; and the second changing bumper impacts the internal surface of the cabin thoroughfare; wherein the first changing bumper is formed as an ellipse.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIG. 3A presents a view of an elevator cylinder having a cabin inserted therein wherein the cabin has a structural plate integral with it; this structural plate further has a liner attached thereto wherein the liner uses an arched pattern in an embodiment disclosed herein.

FIG. 3B presents a view of an elevator cylinder having a cabin inserted therein with a bubble pinpointing the point where a cabin plate liner using an arched pattern impacts the internal structure of the elevator cylinder in an embodiment disclosed herein.

FIG. 3C presents a cross section view of a portion of a cabin and a portion of an elevator cylinder showing the novel liner and bumper in a first position as disclosed in an embodiment disclosed herein.

FIG. 3D presents a cross section view of a portion of a cabin and a portion of an elevator cylinder showing the novel liner and bumper in a second position as disclosed in an embodiment disclosed herein.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
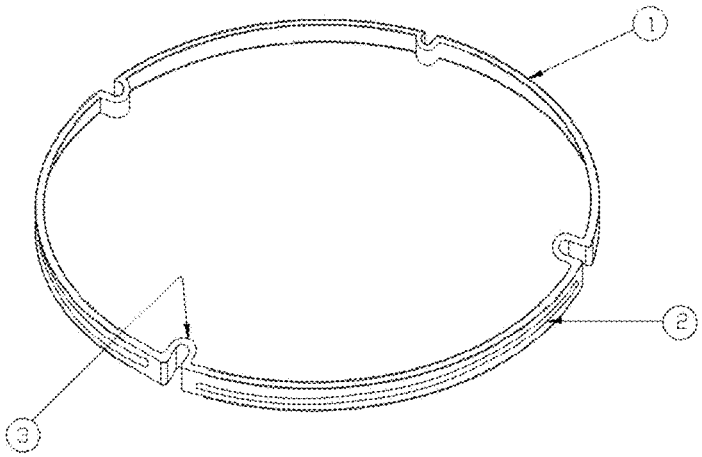
FIG. 1A presents a view of a prior art liner used to attach to a cabin plate using an arc pattern.
Figure 1B:
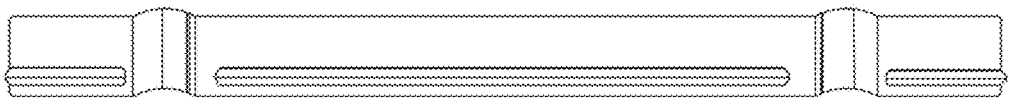
FIG. 1B presents a side view of a prior art liner having a bumper using a linear pattern from this side view.
Figure 1C:
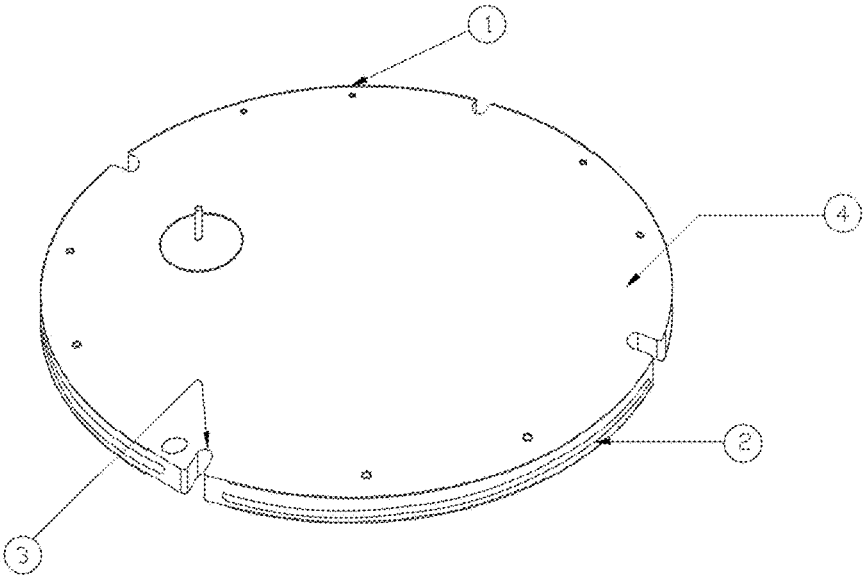
FIG. 1C presents a view of a prior art liner having a bumper using an arc pattern as it is attached to a cabin plate.
Figure 1D:
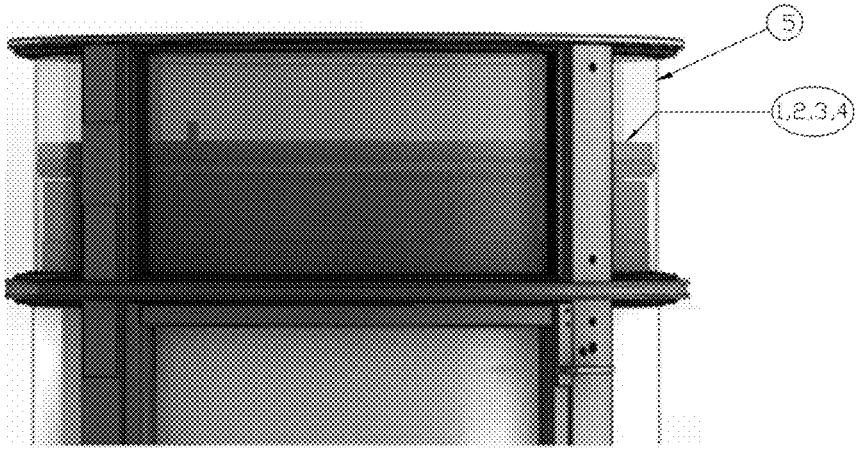
FIG. 1D presents a side view of a prior art elevator cylinder having a cabin inserted therein where the cabin has a liner attached to a cabin plate that is integral with the cabin in an embodiment disclosed herein.
Figure 2A:
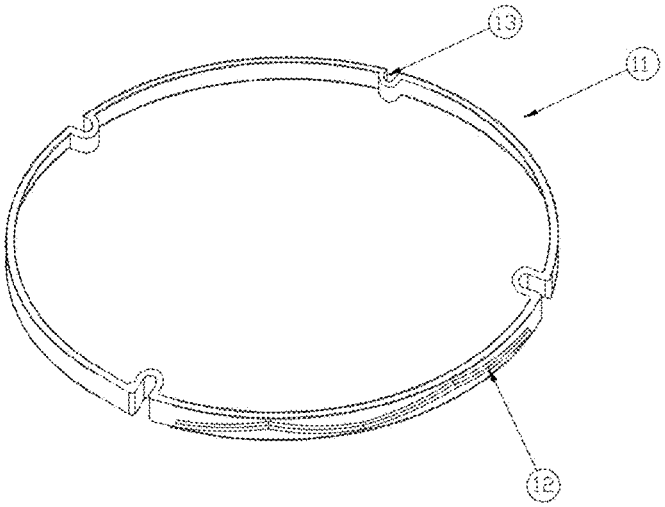
FIG. 2A presents a view of a novel liner having a bumper using an arched pattern in an embodiment disclosed herein.

FIG. 2A presents a view of a novel liner having integral bumpers using an arched pattern in an embodiment disclosed herein. In this embodiment, the liner 11 has various components 11C that are sequentially attached end to end using intermediate U shaped connectors 13. The components 11C are found between each U shaped connector 13. Further, each of the liner 11 components 11C is an integrally extruded part where each has an integral bumper 12 therewith that is formed on the outside of the liner component 11C. Thus, when the liner is completely formed, the bumpers 12 are disposed on the external surface of the liner 11. In this example, an arched, angled or partial triangular pattern of up and down lines shaped as a portion of a triangle that repeats as necessary along the bumpers 12 of components 11C of the liner 11.

Figure 2B:
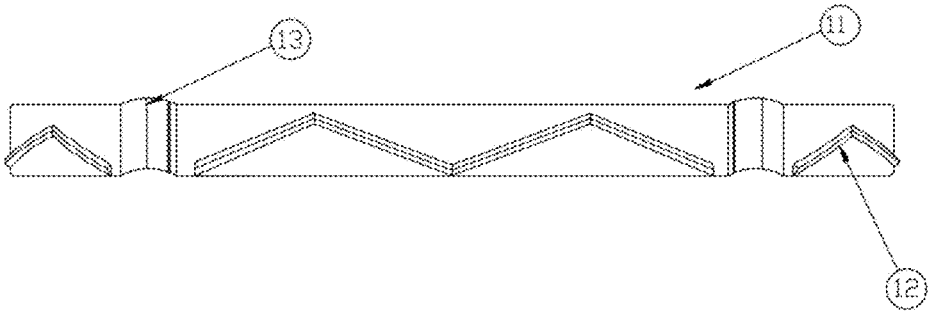
FIG. 2B presents a side view of a novel liner having a bumper using an arched pattern in an embodiment disclosed herein.

FIG. 2B presents a side view of a novel liner having a bumper using arched pattern in an embodiment disclosed herein. In this view, one can clearly visualize the arched pattern (also considered triangular or angled pattern) of up and down lines that form a portion of a triangle; these can also be considered triangle arches. The connectors 13 are U shaped where the top two ends of the U shape are connected one top end to a back surface at the end of a component 11C of the liner 11; and the other top end of the same U shaped connector 13 is attached to a back surface at the end of another component 11C and so forth until a completed liner 11 is formed. Of course, the U shaped connectors 13 are adhesively connected to the liner 11 components 11C so as to permanently attach them thereto.

Figure 2C:
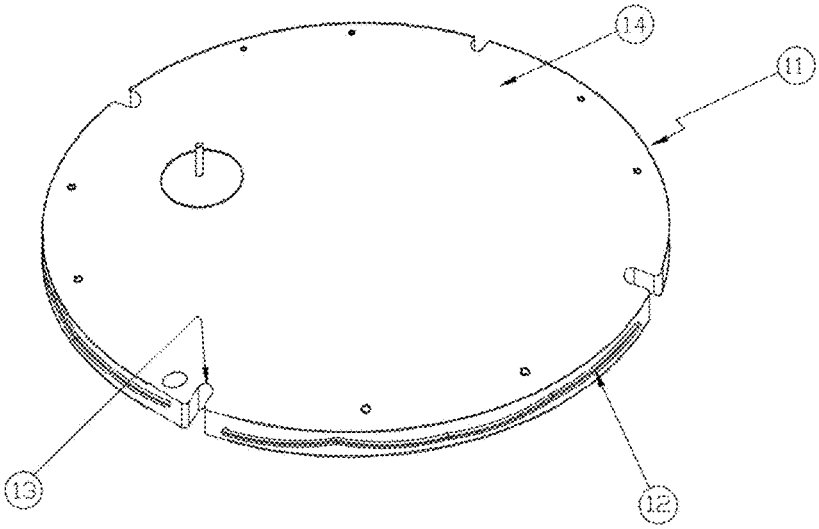
FIG. 2C presents a view of a cabin plate having a liner with a bumper attached thereto where the bumper uses an arched pattern in an embodiment disclosed herein.

FIG. 2C presents a view of a cabin plate having a liner attached thereto; this liner has bumpers using an arched pattern integrally associated with components of the liner in an embodiment disclosed herein. Here the liner 11 components 11C each have a free portion of their respective back surface that is attached to an external circumferential edge of a cabin plate 14 using adhesives so that the bumpers 12 are disposed radially outwards on an external surface of the liner 11 components 11C; as this disposition is away from the cabin plate, the bumpers 12 are able to impact the elevator cylinder internal surfaces. The U shaped connectors 13 are also adhesively attached to U shaped depressions in the cabin plate to ensure a proper engagement of the liner 11 with the cabin plate 14.

FIG. 3A presents a view of an elevator cylinder 15 having a cabin 24 inserted therein further having a liner using an arched pattern attached to the cabin in an embodiment disclosed herein. The liner 11, bumper 12, connectors 13 and cabin plate 14 are all shown in the figure as numerals.

FIG. 3B presents a closeup view of an elevator cylinder having a cabin inserted therein further having a liner using an arched pattern attached to the cabin in an embodiment disclosed herein. This view shows bubble so as to provide an exploded cross section view in FIG. 3C-3D FIG. 3C presents a cross section view of a portion of a cabin and a portion of an elevator cylinder showing the novel liner and bumper in a first position as disclosed in an embodiment disclosed herein.

FIG. 3D presents a cross section view of a portion of a cabin and a portion of an elevator cylinder showing the novel liner and bumper in a second position as disclosed in an embodiment disclosed herein. Here an elevator cylinder portion 17 has a raised portion 18 that causes a bumpy uncomfortable ride in the motion of the cabin in the elevator cylinder. Thus, the novel teachings of an arched bumper help alleviate this problem.

Figure 3E:
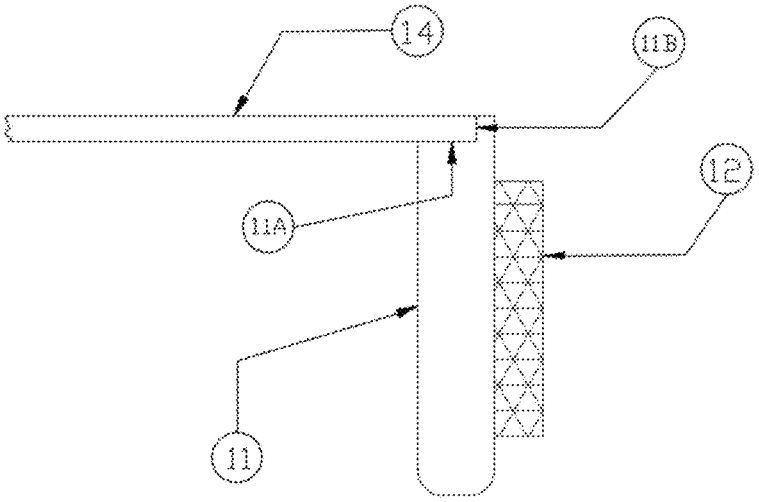
FIG. 3E presents a cross section closeup view of the plate, liner and bumper in an embodiment disclosed herein.

FIG. 3E presents a cross section closeup view of the plate, liner and bumper in an alternative embodiment disclosed herein. The plate 14 has a bottom surface, a top surface and a circumferential edge that integrates the top surface with the bottom surface forming a single unit. A top portion of the liner 11 has a cutout forming a ledge 11A and a raised lip 11B; this cutout is designed to make contact at ledge 11A with a bottom portion of the plate 14 near the circumferential edge thereof and with the circumferential edge along raised lip 11B. Adhesives are applied at 11A, 11B so that appropriate attachment are made with the corresponding portions of the plate 14. Finally, bumper 12 is shown as it transits vertically along this cross section view.

Figure 3F:
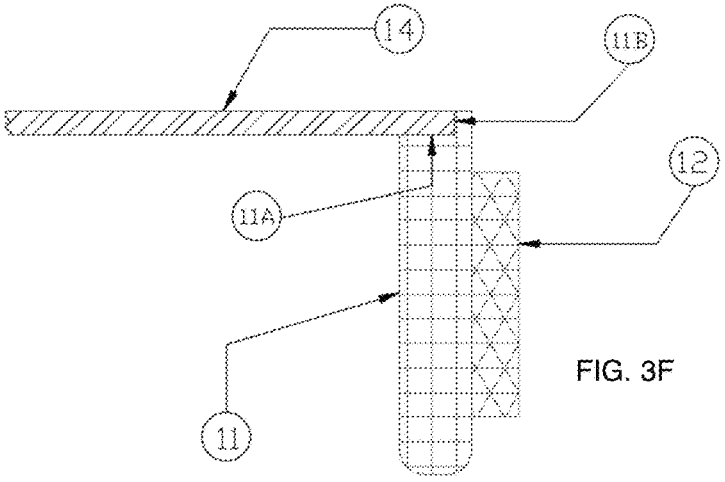
FIG. 3F presents another cross section closeup view of the plate, liner and bumper in an embodiment disclosed herein.

FIG. 3F presents another cross section closeup view of the plate, liner and bumper in another view of the another embodiment of FIG. 3E disclosed herein. The plate 14 has a bottom surface, a top surface and a circumferential edge that integrates the top surface with the bottom surface forming a single unit. A top portion of the liner 11 has a cutout forming a ledge 11A and a raised lip 11B; this cutout is designed to make contact at ledge 11A with a bottom portion of the plate 14 near the circumferential edge thereof and with the circumferential edge along raised lip 11B. Adhesives are applied at 11A, 11B so that appropriate attachment are made with the corresponding portions of the plate 14. Finally, bumper 12 is shown as it transits vertically along this cross section view.

Figure 3G:
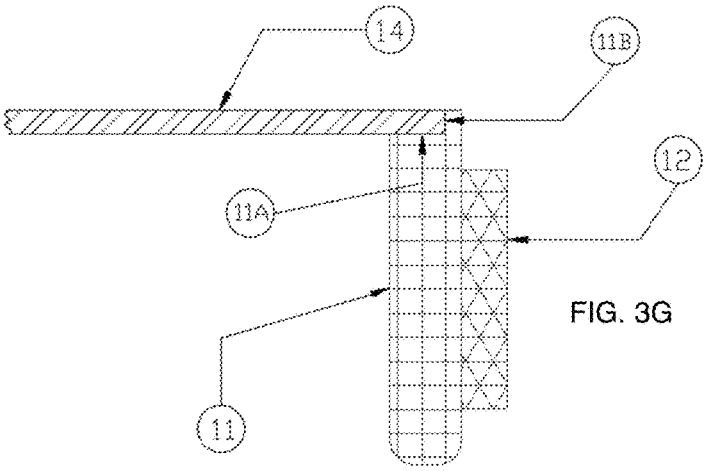
FIG. 3G presents yet another cross section closeup view of the plate, liner and bumper in an embodiment disclosed herein.

FIG. 3G presents yet another cross section closeup view of the plate, liner and bumper of the another embodiment of FIG. 3E disclosed herein. The plate 14 has a bottom surface, a top surface and a circumferential edge that integrates the top surface with the bottom surface forming a single unit. A top portion of the liner 11 has a cutout forming a ledge 11A and a raised lip 11B; this cutout is designed to make contact at ledge 11A with a bottom portion of the plate 14 near the circumferential edge thereof and with the circumferential edge along raised lip 11B. Adhesives are applied at 11A, 11B so that appropriate attachment are made with the corresponding portions of the plate 14. Finally, bumper 12 is shown as it transits vertically along this cross section view.

Figure 4A:
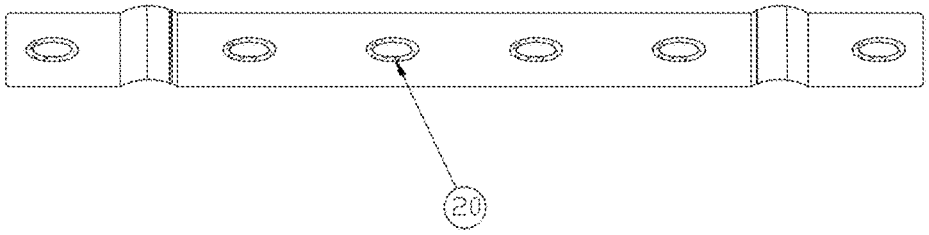
FIG. 4A presents a side view of a liner having a bumper with a elliptical pattern in an embodiment disclosed herein.

FIG. 4A presents a side view of a liner having a bumper with an elliptical pattern in an embodiment disclosed herein. The linear 11 in this embodiment has a bumper with an elliptical pattern with one or more multiple elliptical shown per component of the liner 11. It should be appreciated that any form of curved shape is possible such as elliptical, circle, oval, irregular curve and so forth. It should also be apparent that the patterns change vertically in the image and are separate from one another.

Figure 4B:
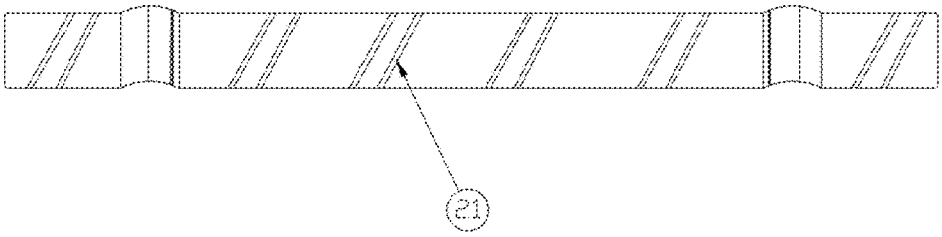
FIG. 4B presents a side view of a liner having a bumper with a diagonal pattern in an embodiment disclosed herein.

FIG. 4B presents a side view of a liner having a bumper with a diagonal pattern in an embodiment disclosed herein. The linear 11 in this embodiment has a bumper with a diagonal pattern so that a line starts at a lower edge of the liner 11 and ends at a top edge thereof with one or more diagonal lines 21 shown parallel to each other then a space there between and followed again by the repetitive pattern shown per component of the liner 11. It should be appreciated that the space between the lines are variable and depend on the needs of the implementation. Thus, one could have as few as one or as many lines as desired and the space between each line could be the length of the liner 11 component 11C and associated two connectors 13 one at each end or as small as mechanically practical. It should also be apparent that the patterns changes as you proceed vertically in the image and are separate from one another.

Figure 4C:
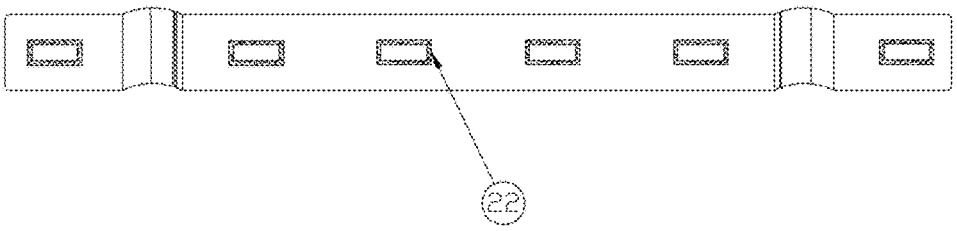
FIG. 4C presents a side view of a liner having a bumper with a polygon pattern in an embodiment disclosed herein.

FIG. 4C presents a side view of a liner having a bumper with a polygon pattern in an embodiment disclosed herein. The linear 11 in this embodiment has a bumper with a polygon pattern with one or more rectangles (or squares) 22 shown per component of the liner 11. It should be appreciated that the space between the rectangles (or squares) 22 are variable and depend on the needs of the implementation. Thus, one could have as few as one or as many rectangles (or squares) 22 as desired and the space between each rectangle (or square) could be the length of the liner 11 component 11C and associated two connectors 13 one at each end or as small as mechanically practical. It should also be apparent that the patterns change vertically in the image (at the vertex between the horizontal and vertical line of the square or rectangular) and are separate from one another.

Figure 4D:
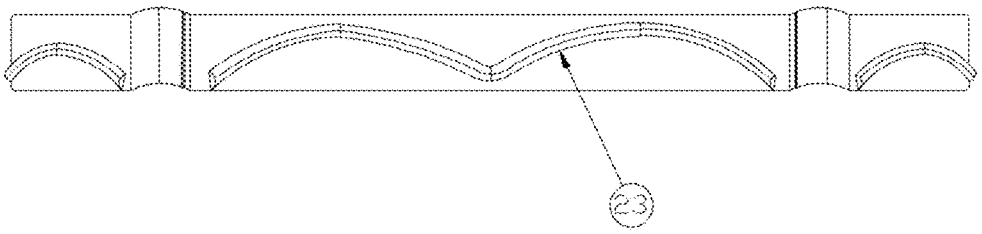
FIG. 4D presents a side view of a liner having a bumper with another arched pattern in an embodiment disclosed herein.

FIG. 4D presents a side view of a liner having a bumper with an arched pattern in an embodiment disclosed herein. The linear 11 in this embodiment has a bumper with an arched pattern with one or more multiple arches connected end to end as shown per component of the liner 11. It should be appreciated that the space between the arches 23 are variable and depend on the needs of the implementation. Thus, one could have as few as one or as many arches 23 as desired and the space between each arch could be the length of the liner 11 component 11C and associated two connectors 13 one at each end or as small as mechanically practical. Here the arched pattern is a curved one and it should also be apparent that the patterns change vertically in the image and but are connected one to another.

Whilst some of the images 20, 21, 22, 23 and the arches of FIG. 2A-2C have been shown in a particular type of shape for the bumpers and associated together or apart, it should be appreciated that these are changeable so as to described numerous variations that are not specifically described. For example, the arched pattern of FIG. 2A-2C or 4D are separable so that there is a discontinuity between each arch. The ellipses of FIG. 4A or polygons of FIG. 4C can be brought together so that there is no discontinuity between each successive one.

Further they can be located higher or lower as required between each successive item. The bumper patterns can also be vertically multiple so that at least one item is directly above another. Additionally, a first component 11C can optionally have one type of bumper and the next component 11C of the same liner can have a different type of bumper. Finally, any regular or random pattern that presents a vertically altered shape or that is continuous or discontinuous are features that are to be generally sought for patent protection. For example, even the prior art simple horizontal line if broken (discontinuous) would be a novel change to facilitate motion up and down since the one or more discontinuities therein would help stop the unwanted excessive gripping action between inner surface of the cylinder and the bumper. Thus, the bumpers described herein have a variety of features that facilitate the smooth ride of the cabin within the elevator cylinder.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An elevator cabin seal comprising:

a first liner component attached to a cabin structural plate and also attached to a connector having a first changing bumper integrally formed on the first liner component wherein the first changing bumper is not inflatable;

a second liner component attached to the cabin structural plate and also attached to the connector having a second changing bumper integrally formed on the second liner component wherein the second changing bumper is not inflatable; wherein the first changing bumper impacts an internal surface of a cabin thoroughfare; and the second changing bumper impacts the internal surface of the cabin thoroughfare; wherein the first changing bumper is formed as an ellipse.

2. An elevator cabin seal system comprising:

an elevator cabin having:

an elevator cabin structural plate having a bottom surface, a top surface and an edge that integrates the top surface with the bottom surface, wherein the elevator cabin structural plate is attached to a top portion of an elevator cabin lateral surface;

a first liner component bumper attached to the edge of the elevator cabin structural plate wherein the first liner component bumper impacts an internal surface of an elevator channel; wherein the first liner component bumper has a cutout on its back side having a lip directly attached to the edge of the elevator cabin structural plate; and a ledge proximal to the lip attached to the bottom side of the elevator cabin structural plate.

3. The elevator cabin seal system of claim 2, wherein the first liner component bumper is formed as a diagonal line.

4. The elevator cabin seal system of claim 2, wherein the first liner component bumper is formed as an arch.

5. The elevator cabin seal system of claim 2, wherein the first liner component bumper is formed as a polygon.

6. The elevator cabin seal system of claim 2, wherein the first liner component bumper is formed as an ellipse.

7. The elevator cabin seal system of claim 2, wherein the first liner component bumper is formed as a curved shape.

8. The elevator cabin seal system of claim 2, wherein the first liner component bumper is formed as a first shape above a second shape.

9. The elevator cabin seal system of claim 2, wherein the first liner component bumper is formed as a first shape followed by a discontinuity and then a second shape.

10. The elevator cabin seal system of claim 2, wherein the first liner component bumper has a diagonal line therewith.

11. The elevator cabin seal system of claim 2, wherein the first liner component bumper has a curved arch therewith.

12. The elevator cabin seal system of claim 2, wherein the first liner component bumper has a triangular arch therewith.

13. The elevator cabin seal system of claim 2, wherein the first liner component bumper has a polygon therewith.

14. The elevator cabin seal system of claim 2, wherein the first liner component bumper has an ellipse therewith.

15. The elevator cabin seal system of claim 2, wherein the first liner component bumper has a curved shape therewith.

16. The elevator cabin seal system of claim 2, wherein the first liner component bumper has a first shape above a second shape therewith.

17. The elevator cabin seal system of claim 2, wherein the first liner component bumper has a line therewith.

18. The elevator cabin seal system of claim 2 further comprising:

wherein the first liner component bumper is from a set of bumpers of diagonal, arch, or ellipse.

19. The elevator cabin seal system of claim 2, wherein the first liner component bumper is from a set of bumpers of: discontinuous, vertically changing, arched, diagonal, polygon, elliptical, circular, oval, regular, irregular, curved, linear.

20. An elevator cabin structural plate liner comprising:

a first liner component having a first bumper integrally formed thereon wherein the first bumper is not inflatable and wherein the first liner component is attached to a connector;

a second liner component having another bumper integrally formed therewith wherein the another bumper is not inflatable and wherein the second liner component is attached to the connector; such that the first liner component and the second liner component and the connector are attached to a lateral edge of a structural cabin plate; and wherein the first bumper is from a set of bumpers of: triangular arch, ellipse, diagonal line.

* * * * *